US007969074B2

(12) United States Patent
Stockwald et al.

(10) Patent No.: US 7,969,074 B2
(45) Date of Patent: Jun. 28, 2011

(54) LOW PRESSURE DISCHARGE LAMP

(75) Inventors: Klaus Stockwald, Germering (DE); Herbert Weiβ, Deisenhofen (DE)

(73) Assignee: OSRAM Gesellschaft mit beschränkter Haftung, München (DE)

( * ) Notice: Subject to any disclaimer, the term of this patent is extended or adjusted under 35 U.S.C. 154(b) by 109 days.

(21) Appl. No.: 12/311,271

(22) PCT Filed: Oct. 10, 2007

(86) PCT No.: PCT/EP2007/060737

§ 371 (c)(1), (2), (4) Date: Mar. 24, 2009

(87) PCT Pub. No.: WO2008/046770

PCT Pub. Date: Apr. 24, 2008

(65) Prior Publication Data

US 2009/0273267 A1 Nov. 5, 2009

(30) Foreign Application Priority Data

Oct. 17, 2006 (DE) ..... 10 2006 048 983

(51) Int. Cl.

| | |
|---|---|
| ***H01J 61/52*** | (2006.01) |
| ***H01J 65/04*** | (2006.01) |
| ***H01J 61/70*** | (2006.01) |
| ***H01J 61/12*** | (2006.01) |

(52) U.S. Cl. ..... 313/46; 313/13; 313/22; 313/25; 313/33; 313/36; 313/44; 313/161; 313/634; 313/493

(58) Field of Classification Search ..... None
See application file for complete search history.

(56) References Cited

U.S. PATENT DOCUMENTS

| | | | | |
|---|---|---|---|---|
| 2,765,416 | A | 9/1953 | Beese et al. | |
| 3,657,590 | A | 4/1972 | Johnson | |
| 4,916,352 | A | 4/1990 | Haim et al. | |
| 4,949,003 | A * | 8/1990 | Cox et al. | 313/25 |
| 5,572,083 | A * | 11/1996 | Antonis et al. | 313/46 |
| 6,072,268 | A | 6/2000 | Dolan et al. | |
| 2004/0169456 | A1 | 9/2004 | Scholl et al. | |
| 2006/0132042 | A1 | 6/2006 | Smith et al. | |
| 2008/0030115 | A1 * | 2/2008 | Erofeev et al. | 313/35 |

FOREIGN PATENT DOCUMENTS

| | | | |
|---|---|---|---|
| DE | 197 31 168 | A1 | 1/1999 |
| DE | 101 29 464 | A1 | 1/2003 |
| EP | 0 698 914 | A1 | 12/1993 |
| EP | 0 698 914 | B1 | 12/1993 |

* cited by examiner

*Primary Examiner* — Ashok Patel
(74) *Attorney, Agent, or Firm* — Holtz, Holtz, Goodman & Chick, P.C.

(57) ABSTRACT

The invention relates to a mercury-free low pressure discharge lamp with a discharge vessel having an ionizable filling. The surface temperature of the discharge vessel, and thus the temperature of the ionizable filling, can be adjusted at least in some sections such that an emitting substance can produce the radiation required for the excitation of the luminescent substance. The temperature of the fluid is preferably adjusted in a temperature control circuit, using a temperature sensor, a pump and a heating device.

14 Claims, 3 Drawing Sheets

LOW PRESSURE DISCHARGE LAMP

Figure 1A:
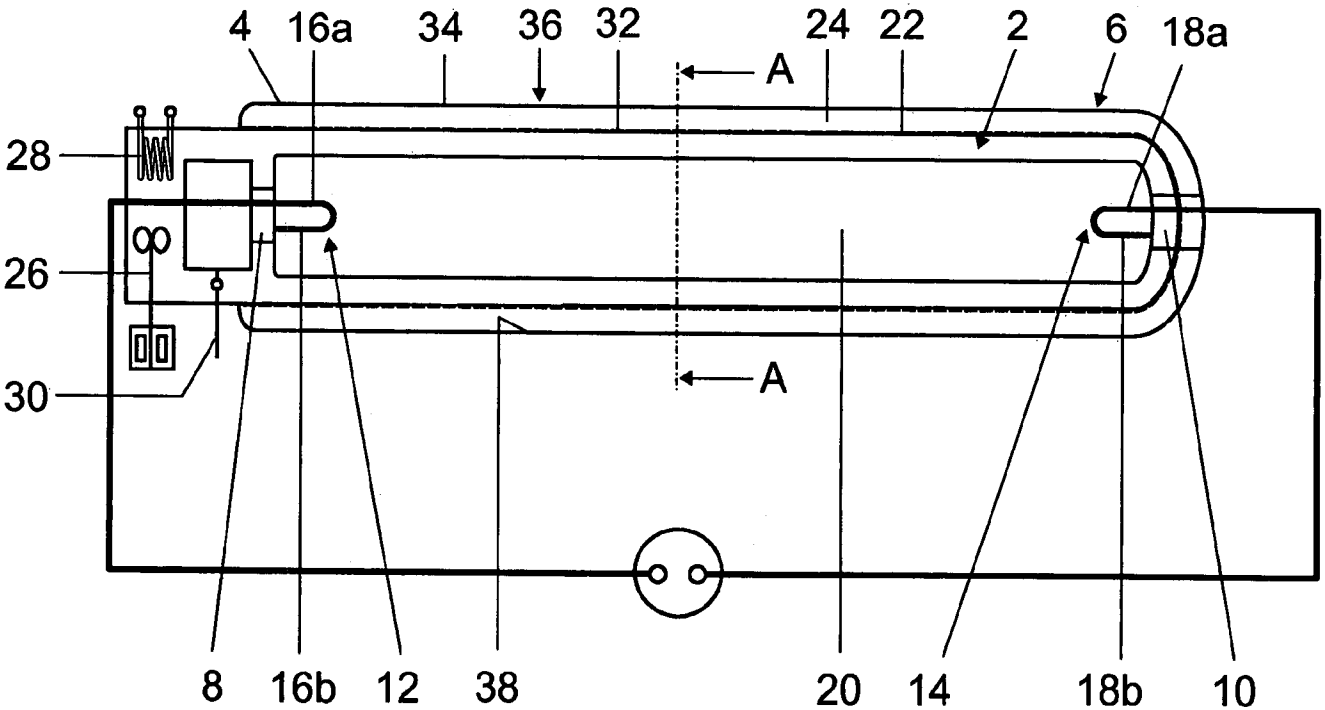

This application is a U.S. National Phase Application under 35 USC 371 of International Application PCT/EP2007/060737, filed Oct. 10, 2007, which is incorporated herein in its entirety by this reference.

TECHNICAL FIELD

The invention relates to a low pressure discharge lamp that can be designed with electrodes or in an electrodeless fashion, and whose ionizable filling requires an increased temperature for the emission.

PRIOR ART

Mercury and sodium low pressure lamps are frequently used as discharge lamps. Because they lack color rendition properties, sodium low pressure lamps, which radiate monochromatic yellow light, can be used only to a limited extent. There is a wide field of use for mercury low pressure lamps, which are also denoted as fluorescent lamps and in the case of which the ultraviolet radiation generated in the discharge space and having the resonance lines of 254 nm and 185 nm can be converted into visible radiation with the aid of phosphors applied to the discharge vessel. Mercury is preferred for low pressure discharge lamps, since the luminous flux is at a maximum for an ambient temperature of approximately 25° C.

In recent years, mercury has come to be regarded increasingly as environmentally damaging and as a toxic substance that is to be avoided in modern mass production, including with regard to a problem-free disposal of illumination bodies.

Patent application DE 197 31 168 A1 of the same inventor discloses mercury-free high pressure lamps in the case of which the lighting and electrical characteristics of typical metal halide high pressure lamps are obtained. Because of the different requirements placed on high pressure lamps and low pressure lamps, the mercury-free filling and the configuration of the discharge vessel cannot be transferred to low pressure lamps.

SUMMARY OF THE INVENTION

The invention is based on the object of providing a low pressure discharge lamp that is of mercury-free design and offers optimal conditions for the excitation of the ionizable filling.

This object is achieved according to the invention by the features of claim 1.

An inventive mercury-free low pressure discharge lamp has a fluid and a discharge vessel in which an ionizable filling is present. The ionizable filling has an inert gas or a mixture of a plurality of inert gases at a pressure of between 0.1 and 100 hPa, and an emitting material for generating the radiation required for the phosphor excitation. The surface temperature of the discharge vessel can be set with the aid of the fluid, at least in some sections. Despite a renunciation of mercury, which vaporizes easily under the usual operating conditions for fluorescent lamps and generates with a particularly high efficiency in the low pressure discharge the UV radiation required for the phosphor excitation, a high light yield can be achieved in the case of the inventive mercury-free low pressure discharge lamp.

It is preferred when the emitting material has at least one metal halide, a metal and/or an organometallic compound (for example. chelate) of the metals Fe, Co, Ni, Cu. Al, Ga, In, Ti, Ge, Sn, Se, Te, Cr. It is thereby possible to implement a mercury-free low pressure discharge lamp of high efficiency.

It is advantageous when the surface temperature can be set with the aid of the fluid at the coldest site of the discharge vessel, the fluid being resistant to high temperatures. It is thereby possible to set high surface temperatures at the discharge vessel with regard to optimal vapor pressure conditions for the desired molecular mixture of the ionizable filling.

In an advantageous embodiment, a temperature setting device is provided by which the temperature of the fluid can be set accurately to ±25 K in the range from 150 to 350° C. It is thereby possible to implement optimal light yields over a lengthy time period.

The fluid is preferably transparent or translucent and preferably has a silicone oil, it thereby being possible to implement an accurate temperature control without a sharp reduction in the light yield.

The fluid can be located in an envelope that surrounds the discharge vessel at least in some sections, such that the energy loss during heating of the discharge vessel can be minimized.

It is preferred for a phosphor layer to be provided that is applied at least in some sections to the inner periphery of the discharge vessel. Consequently, as in the case of a conventional fluorescent lamp, the conversion of emitted radiation into visible radiation is performed at the discharge vessel.

In a further embodiment, the fluid has a phosphor admixture by means of which the radiation produced in the discharge vessel can be converted into visible radiation. The fluid thus has a dual function: both temperature control of the discharge vessel, and generation of the visible radiation. The step of applying the phosphor layer is then lost as a result.

At least in some sections, the envelope can be surrounded by a vacuum casing that minimizes the heat emission of the discharge lamp.

The discharge-vessel is preferably of rod-shaped, annular or U-shaped design so as to enable comparable units of use as in the case of conventional fluorescent lamps.

In yet a further embodiment, the discharge lamp is of electrodeless design, in which the discharge vessel is designed in such a way that a toroidal gas discharge volume results and the discharge is triggered via inductive input coupling. Furthermore, it is preferred when the discharge lamp is of electrodeless design, the discharge vessel is substantially of spherical design, and the discharge is triggered via inductive input coupling. It is possible in this way for cylindrical or spherical discharge vessels to be implemented without additionally inserted electrodes, that is to say with a homogeneous inner surface.

Inventive developments are disclosed in the subclaims.

BRIEF DESCRIPTION OF THE DRAWING(S)

Figure 1B:
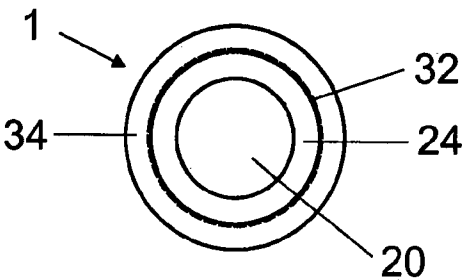
Figure 2:
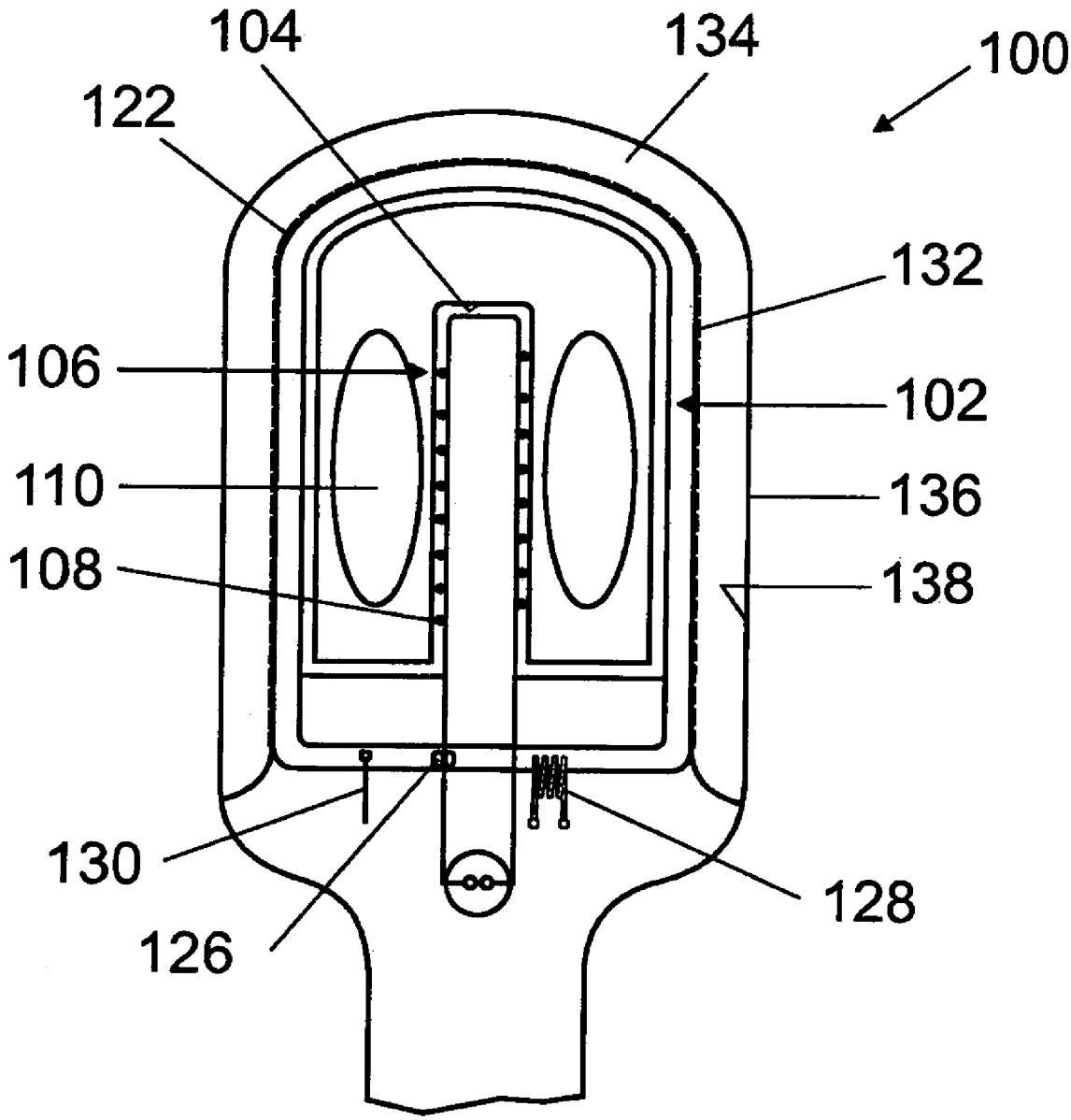
Figure 3:
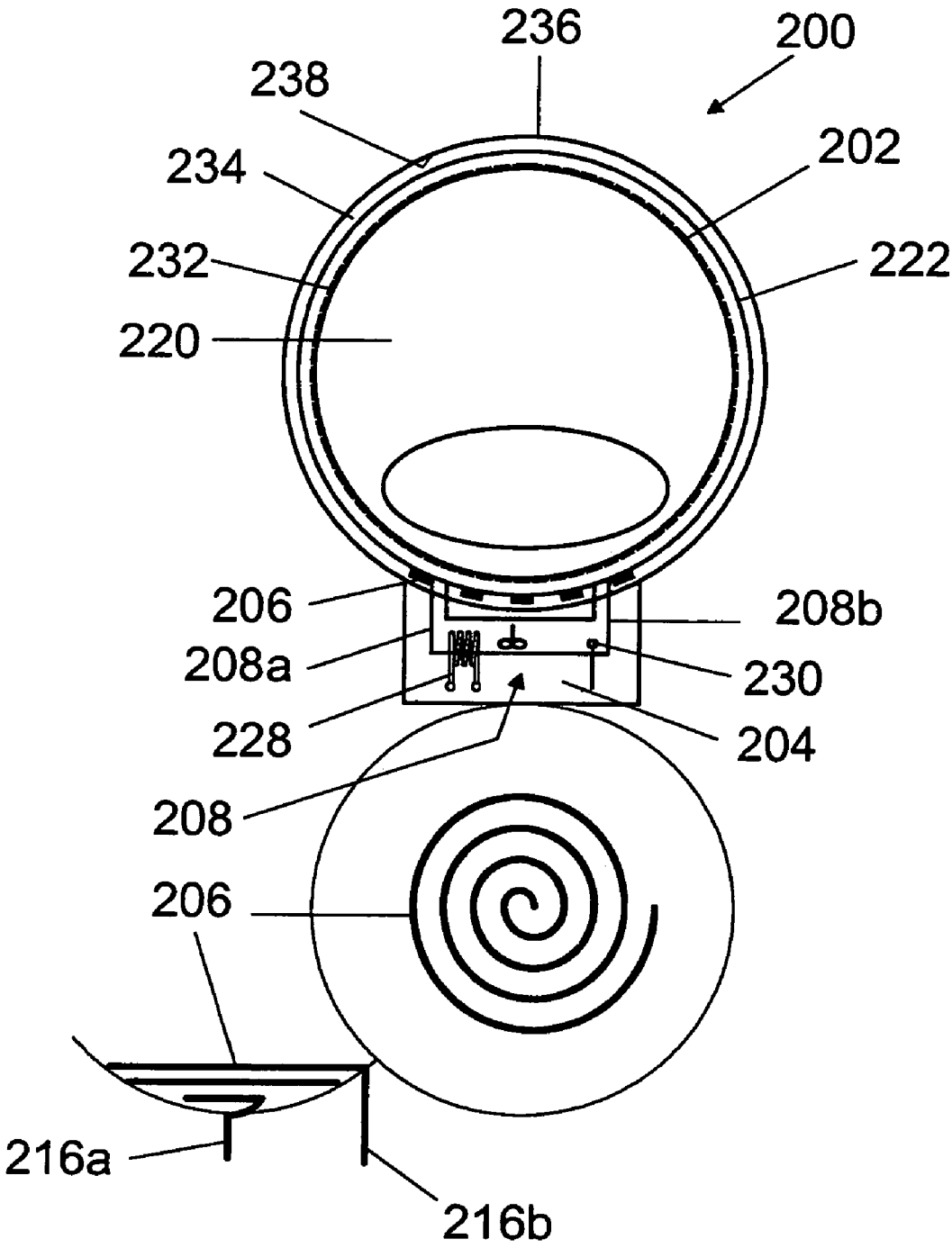

The invention is explained in more detail below with the aid of preferred exemplary embodiments. In the drawing(s):

FIG. 1A shows a mercury-free low pressure discharge lamp corresponding to the first exemplary embodiment, and FIG. 1B shows a cross section through the low pressure discharge lamp of FIG. 1A along. the line A-A, FIG. 2 shows a mercury-free low pressure discharge lamp corresponding to the second exemplary embodiment, and FIG. 3 shows a mercury-free low pressure discharge lamp corresponding to the third exemplary embodiment.

PREFERRED DESIGN OF THE INVENTION

An inventive lamp is now described with reference to the first exemplary embodiment, shown in FIG. 1A.

The inventive lamp corresponding to the first exemplary embodiment is a mercury-free low pressure discharge lamp 1. The lamp 1 has a tubular discharge vessel 2, the two end sections 4, 6 of which are sealed in a gas-tight fashion.

An electrode frame 8, 10 is respectively fused to the ends 4, 6 of the discharge vessel 2. The electrode frames 8, 10 respectively have an electrode coil 12, 14 and two power supply wires 16*a*, 16*b*, 18*a*, 18*b* electrically connected to the ends of the electrode coils 12, 14. The electrode coils 12, 14 are arranged in the interior 20 of the discharge vessel 2 and transverse to the longitudinal axis of the discharge vessel 2.

Present in the interior 20 of the discharge vessel 2 as ionizable filling are mercury-free, emitting materials in the form of inert gas/molecular gas mixtures. This mixture has a base gas in the form of an inert gas or of an inert gas mixture, for example composed of at least one of the inert gases Ar, Ne, He, Xe, Kr, in a pressure range of typically 0.1 to 100 hPa. At least one metal halide and/or one of the metals Fe, Co, Ni, Cu, Al, Ga, In, Ti, Ge, Sn, Se, Te, Cr are present in the fill gas for the ionization and excitation. It is preferred for the metal to be present in the form of organometallic chelate compounds.

The discharge vessel 2 of the first exemplary embodiment is designed, for example, with a diameter of 25 mm and a length of 200 mm. In this example, the ionizable filling in the interior has Ar with a pressure of 2.5 hPa, and a mixture composed of InBr and InCl and metallic In with 0.2 mg respectively.

An increased wall temperature in the range from approximately 150 to approximately 400° C., preferably up to 350° C., is required to produce the vapor pressure of the ionizable filling.

The inventors have found that the optimum excitation of the ionizable filling occurs under specific pressure conditions in relation to the dimensions in use of the discharge vessel, in the first exemplary embodiment with reference, in particular, to the tube diameter, given a simultaneously relatively accurate setting of a homogeneous temperature distribution along the wall of the discharge vessel. The temperature at the coldest point of the discharge vessel, at the so-called cold spot, is of particular interest in this case. The inventors have found it particularly favorable to use a fluid for the temperature control of the outer wall of the discharge vessel.

In order to undertake such temperature control with a fluid, the discharge vessel 2 is surrounded over its entire longitudinal axis by a thin-walled envelope 22 in which there is located a fluid 24 that can be temperature controlled, is transparent in the visible and close to the UV-region and is resistant to high temperatures. This fluid 24 surrounds the discharge chamber 2 including the cold spot, and is, for example, silicone oil, in particular methylphenyl polysiloxane.

The fluid layer about the vessel has a layer thickness approximately from 0.1 to 3 mm, and is circulated by a pump 26 via a heating device 28. The pump 26 is, for example, a diaphragm pump or a vane pump. Furthermore, there is located in the thermal circuit, near the fluid outlet from the envelope 22, a temperature sensor 30 whose output signal passes to an electrical control circuit (not illustrated in FIG. 1*a*) in which, for example, a prescribed temperature of approximately 220° C.±15 K is set in the fluid via the heating device 28. By means of such control, the temperature of the outer wall of the discharge vessel 2 can be controlled in a narrow temperature range of approximately ±25 K.

The heating device 28, the pump 26 and the temperature sensor 30 are located in FIG. 1 in a base of the low pressure lamp 1 at an end section 4 next to the electrode coil 8, and enable the discharge vessel to be continuously flowed around by the fluid so that a desired temperature is present at the discharge vessel. In addition, it is also possible to provide in the base of the low pressure lamp 1 a heat exchanger that can make use in the fluid 24 of the heat of the electrode coils 12, 14 and/or of the power supply wires 16*a*, 16*b*.

For the heating device 28, inter alia also for radiation heating, it is possible to make use of a thin heating wire of coiled design, or of a resistance layer, applied to the discharge vessel, along the entire extent of the discharge vessel. This heating wire or resistance layer can be located in direct contact with the fluid in use so as to be able to obtain a uniform and energy-efficient heating of the fluid 24.

Located on the inner surface of the envelope 22 is a phosphor coating 32 that converts into visible light the radiation, emitted on the basis of the gas discharge, from the ionizable filling. In this case, the radiation emitted from the discharge lies in the excitation range of the phosphor of the phosphor coating.

The discharge vessel 2 and the envelope 22 are surrounded by a vacuum casing 34 that is bounded by an outer member 36. Applied to the inner wall of the outer member 36 is an infrared reflection layer by means of which the infrared radiation generated in the discharge vessel and emerging through the envelope 22 is reflected again to the discharge vessel 2.

In order to start up the discharge lamp, the fluid 24 is subjected to rapid heating with the aid of an increased volume flow produced by the pump 26 such that the time required to heat up to the optimum temperature is short.

The electrode coils 12, 14 are preheated to a temperature of approximately from 850 to 900° C., for example by electrical preheating, before the starting of the discharge lamp.

During operation of the discharge lamp, it is desirable to set the coldest point of the discharge vessel in accordance with the optimum vapor pressure conditions for the ionizable filling. In this case, the sections of the discharge vessel along which the discharge exciting radiation occurs can be controlled to higher temperatures, of up to 50-75 K, than the temperature-controlled coldest point. As a result, an accurate temperature control of the fluid 24 in the envelope 22 can be reduced to a temperature control substantially in the region of the cold spot of the discharge vessel. The remaining regions of the wall of the discharge vessel therefore have a temperature increased by 25-75 K.

During a dimming operation of the discharge lamp, the optimum cold spot temperature of the discharge lamp can be actively set by controlling the temperature of the fluid 24 such that an optimum radiation yield can be obtained from the discharge even given a substantially reduced discharge power.

In a modification of the first exemplary embodiment, no phosphor coating 32 is provided on the envelope 22, but there are provided in the fluid guided around the envelope 22 phosphor particles, for example in the form of a solid/powder mixture, that are uniformly distributed because of the fluid flow around the discharge vessel and have the function of the phosphor coating 32, that is to say they are excited to shine in the visible range because of the discharge performed in the discharge vessel.

The above-described first exemplary embodiment relates to a low pressure discharge lamp with an electrode coil for starting and for coupling-in energy. The present invention is, however, not restricted thereto—rather, any desired electrical or electromagnetic excitation methods can be used for starting and coupling energy into any desired discharge vessel. This is described below by way of example with reference to the second and third exemplary embodiments.

FIG. 2 shows an electrodeless low pressure discharge lamp 100 corresponding to the second exemplary embodiment and having a discharge vessel 102 of cylindrical design into which an internal recess 104 for an elongated coil 106 has been introduced. This coil 106 has a primary winding 108. The primary winding 108 is connected at its ends to a radio frequency supply so that there is generated around the primary winding a radio frequency magnetic field with the aid of which the discharge is maintained in a toroidal region 110 of the interior 120 of the discharge vessel 102.

The type of ionizable filling, and the envelope 122 with a fluid 124 which flows around the discharge vessel 102 through a pump 126, the temperature sensor 130 as sensor for the temperature control, the phosphor coding 132 on the envelope 122, the vacuum casing 134 and the outer member 136 with infrared coding 138 correspond to the comparable elements of the first exemplary embodiment, and so reference is made to the first exemplary embodiment as regards the mode of operation.

In the case of the low pressure discharge lamp 200, shown in FIG. 3, corresponding to the third exemplary embodiment, the discharge vessel 202 is of spherical design. The ionizable filling is provided in the interior 220, and the discharge vessel 202 is surrounded by a fluid 224 held by an envelope 222.

Applied to the envelope 222 in a spiral-like fashion is a conductor track 206 to which it is possible via two power supply wires 216*a*, 216*b* to apply a radio frequency voltage by means of which a radio frequency magnetic field can be generated in the discharge vessel 202. This magnetic field maintains a discharge in the region 210 in the interior 220 of the discharge vessel 202.

Provided next to the conductor track 206 on the envelope 222 is an extension piece 208 with two fluid feed lines 208*a*, 208*b* that lead cooled fluid away from the outer wall of the discharge vessel, and heated fluid toward the outer wall of the discharge vessel. Located between the fluid feed lines 208*a*, 208*b* is a temperature setting section 204 in which the pump 226, the heating device 228 and the temperature sensor 230 are provided. The extension piece 208 enables the fluid 224 to flow away from the outer wall of the discharge vessel 202 and be brought up to a predetermined temperature before once again flowing toward the outer wall of the discharge vessel. The phosphor coating 232 on the envelope 222, the vacuum casing 234, the outer member 236 and the infrared coating 238 are of spherical design in the third exemplary embodiment, the correspond, however, terms of function to the comparable elements of the first exemplary embodiment, and so no detailed description will be given.

The coupling of power into the discharge is typically 2-50 W into the given volume, while electromagnetic energy is coupled in by an alternating electric field in the range of approximately 50 Hz-3 GHz.

The present invention is not restricted to the shape of the discharge vessel, envelope and outer member of the first to third exemplary embodiments—rather, any desired shapes and dimensions of these discharge vessels/members may be present if it is possible to implement a mercury-free low pressure discharge lamp in which the surface temperature of the discharge vessel can be set.

The invention thus relates to a mercury-free low pressure discharge lamp having a discharge vessel in which an ionizable filling is present. The surface temperature of the discharge vessel, and thus the temperature of the ionizable filling can be set, at least in some sections, such that an emitting material can generate the radiation required for the phosphor excitation. It is preferred to control the temperature of the fluid via a temperature control circuit by using a temperature sensor, a pump and a heating device.

The invention claimed is:

1. A mercury-free low pressure discharge lamp (1, 100, 200) generating a radiation, said low pressure discharge lamp comprising:

a discharge vessel(2) in which an ionizable filling is present, a fluid, an envelope (22) that at least partially surrounds the discharge vessel(2) and a temperature setting device operable to set the temperature of the fluid, said ionizable filling has a) an inert gas or a mixture of a plurality of inert gases at a pressure of between 0.1 and 100 hPa and b) an emitting material for generating the radiation.

2. The low pressure discharge lamp as claimed in claim 1, in which the emitting material has at least one metal halide, a metal and/or an organometallic chelate of the metal and wherein the metal is selected from the group consisting of Fe, Co, Ni, Cu, Al, Ga, In, Ti, Ge, Sn, Se, Te, and Cr.

3. The low pressure discharge lamp as claimed in claim 1 or 2, in which a predetermined portion of a surface of the discharge vessel has its surface temperature set by the fluid, the fluid being resistant to high temperatures.

4. The low pressure discharge lamp as claimed in claim 1 or 2, wherein said temperature setting device is operable to set the temperature of the fluid accurately to ±25 K in the range from 150 to 350° C.

5. The low pressure discharge lamp as claimed in claim 1 or 2, in which the fluid (24) is transparent or translucent.

6. The low pressure discharge lamp as claimed in claim 2, in which the emitting material is the organometallic chelate.

7. The low pressure discharge lamp as claimed in claim 5, in which the fluid (24) is silicone oil.

8. The low pressure discharge lamp as claimed in claim 1, in which the fluid (24) has a phosphor admixture by means of which the radiation is converted into visible radiation.

9. The low pressure discharge lamp as claimed in claim 1, in which a phosphor layer is provided that is applied to at least a portion of the inner periphery of the discharge vessel (2) or of the envelope (22) and is operable to convert the radiation into visible light.

10. The low pressure discharge lamp as claimed in claim 1, in which the discharge vessel (2) is of rod-shaped, annular or U-shaped design.

11. The low pressure discharge lamp (100) as claimed in claim 1, that is of electrodeless design, in which the discharge vessel (102) is of cylindrical design with an internal recess and an inserted coil, whereby a discharge is triggered via inductive input coupling.

12. The low pressure discharge lamp (200) as claimed in claim 1, that is of electrodeless design, in which the discharge vessel (202) is substantially of spherical design, and the envelope (22) has a conduction track (206) applied to it in a spiral-like fashion and by which a discharge is triggered via inductive input coupling.

13. A mercury-free low pressure discharge lamp (1, 100, 200) with a discharge vessel (2) in which an ionizable filling is present, which has a) an inert gas or a mixture of a plurality of inert gases at a pressure of between 0.1 and 100 hPa and b) an emitting material for generating the radiation required for the phosphor excitation, and having an envelope (22) that at least partially surrounds the discharge vessel (2) and a fluid (24) with the aid of which a surface temperature of the discharge vessel (2) can be set, at least in some sections and wherein a phosphor layer is provided that is applied to at least a portion of the inner periphery of the discharge vessel (2) or of the envelope (22) and having a vacuum casing (34) that surrounds the envelope (22) at least in some sections.

14. A mercury-free low pressure discharge lamp (1, 100, 200) with a discharge vessel (2) in which an ionizable filling is present, which has a) an inert gas or a mixture of a plurality of inert gases at a pressure of between 0.1 and 100 hPa and b) an emitting material for generating the radiation required for the phosphor excitation, and having an envelope (22) that at least partially surrounds the discharge vessel (2) and a fluid (24) with the aid of which a surface temperature of the discharge vessel (2) can be set, at least in some sections and wherein the fluid (24) has a phosphor admixture by means of which the radiation produced in the discharge vessel can be converted into visible radiation and having a vacuum casing (34) that surrounds the envelope (22) at least in some sections.

* * * * *